US006966100B2

(12) United States Patent
Sonne

(10) Patent No.: US 6,966,100 B2
(45) Date of Patent: Nov. 22, 2005

(54) TOOL HAVING A SUPPORT

(76) Inventor: Lawrence Julius Sonne, 4864 Hillcrest, Okemos, MI (US) 48864-1631

( * ) Notice: Subject to any disclaimer, the term of this patent is extended or adjusted under 35 U.S.C. 154(b) by 0 days.

(21) Appl. No.: 10/421,183

(22) Filed: Apr. 23, 2003

(65) Prior Publication Data

US 2003/0196296 A1 Oct. 23, 2003

Related U.S. Application Data

(60) Provisional application No. 60/374,764, filed on Apr. 23, 2002.

(51) Int. Cl.[7] ..... B25G 3/00; B25G 1/04; A45C 13/22

(52) U.S. Cl. ..... 16/110.1; 16/425; 16/422; 15/105; 7/151; 30/169

(58) Field of Search ..... 16/425, 422, DIG. 12, 16/DIG. 19, 110.1; 294/27.1, 31.1, 32; 220/758, 759, 769, 764; 15/105, 104.001, 104.5, 104.94, 236.01, 236.03, 159.1; 7/151–153, 105, 156; 248/210–211; 30/169, 450; D32/39, 40, 46

(56) References Cited

U.S. PATENT DOCUMENTS

| | | | | | |
|---|---|---|---|---|---|
| 175,615 | A | | 4/1876 | Mackintosh | |
| 484,335 | A | | 10/1892 | Moss | |
| 1,674,305 | A | | 6/1928 | Sedlock et al. | |
| 1,676,648 | A | * | 7/1928 | Hardiman | 81/3.57 |
| 2,639,502 | A | * | 5/1953 | Wormelle, Jr. | 30/450 |
| 2,652,278 | A | * | 9/1953 | Allen | 294/15 |
| 2,993,672 | A | * | 7/1961 | Bower et al. | 248/211 |
| 4,234,988 | A | * | 11/1980 | Ross et al. | 7/151 |
| 4,631,769 | A | * | 12/1986 | White | 7/151 |
| 4,658,455 | A | * | 4/1987 | Skillern | 7/105 |
| 4,984,324 | A | * | 1/1991 | Farris | 15/236.05 |
| 5,000,210 | A | | 3/1991 | Worthington, Jr. | |
| 5,083,813 | A | | 1/1992 | Adkins | |
| 5,087,014 | A | * | 2/1992 | Desjardin | 248/692 |
| 5,427,343 | A | | 6/1995 | Ferris | |
| 5,568,665 | A | * | 10/1996 | Fick | 7/105 |
| 5,624,095 | A | | 4/1997 | Zissu | |
| 5,860,239 | A | | 1/1999 | Thalenfeld et al. | |
| 6,061,862 | A | | 5/2000 | Whitaker | |
| 6,640,369 | B1 | * | 11/2003 | Malvasio | 7/105 |
| 6,641,321 | B2 | | 11/2003 | Horng | |
| 6,658,701 | B1 | * | 12/2003 | DeHart et al. | 16/425 |
| 6,702,113 | B2 | | 3/2004 | Marino | |
| 2003/0088933 | A1 | | 5/2003 | Woods et al. | |

FOREIGN PATENT DOCUMENTS

| | | | | |
|---|---|---|---|---|
| EP | 3379 A | * | 8/1979 | A47L/13/08 |
| GB | 2245880 A | * | 1/1992 | B65D/25/28 |
| GB | 2356008 A | * | 5/2001 | E06C/7/14 |

* cited by examiner

*Primary Examiner*—Chuck Mah
(74) *Attorney, Agent, or Firm*—Mary M. Moyne; Ian C. McLeod

(57) ABSTRACT

The present invention relates to an improved method and device for supporting a tool (16, 16A, 16B, 16C, 16D, 16E 16F, 16G or 16H) or display item (16J) on the rim (17, 47A or 87) of a container (18, 47, 87A or 88), a support bracket (36), a support rod (45 or 45B, or a flat surface (9). The support (12, 12B, 32, 42, 52, 62, 72, 82, or 92) extends from the handle (13, 38, 43, 53, 63, 77, or 83) of the tool or the joining leg (93) of the universal support hanger and has an aperture (16, 16B, 16C, 16D, 16E, 16F, 16G, 14H or 16J) with a sloping line (14, 14B, 14C, 14D, 14E, 14F, 14G, 14H or 14J). The sloping line creates a variable sized aperture. The internal surface of the variable sized aperture is in contact with the rim of the container, support bracket or upper support rod thereby securing the tool or universal support hanger in a predetermined position. Alternatively, increased gravitational friction between the sloping line in the aperture and the container, support bracket or support rod due to the center of gravity of the tool in relation to the aperture impedes unintentional dislodging of the tool.

12 Claims, 10 Drawing Sheets

TOOL HAVING A SUPPORT

CROSS-REFERENCE TO RELATED APPLICATIONS

This application claims the benefit of provisional application No. 60/374,764 filed Apr. 23, 2002.

FEDERALLY SPONSORED RESEARCH

Not Applicable

SEQUENCE LISTING OF PROGRAM

Not Applicable

BACKGROUND OF THE INVENTION

1. Field of the Invention

This invention relates to a method for supporting tools in a specific position and providing additional resistance to removal from a container or support rod. In particular, the present invention relates to a method of securing tools such as spatulas, trowels, scrapers, garden tools, tooth brushes, razors, task tool handles, instruments, kitchen utensils and support hangers for display items.

2. Description of the Related Art

The screen printing industry prints garments with a vinyl based ink that only dries when heated in a drying oven. The ink gets on the handles of conventional spatulas that fall into the ink buckets and thus the hand of the operator. Contamination of the work environment and the product with misdirected ink is costly for the industry.

Typically the industry uses flat blade metal scrapers, plastic scrapers, wooden stir sticks, and plastic spatulas from the food industry. They have a common disadvantage in that none have a means to secure them to the bucket to prevent tool-handle contamination. Additionally, the operator often kicks the messy bucket across the floor dislodging casually rested tools from the sides of the bucket and the tool handles become contaminated with the ink.

The related art shows various methods of supporting tools, paintbrushes, toothbrushes, a razor and support clips. Illustrative are U.S. Pat. No. 5,065,977 to Desjardin; U.S. Pat. No. 6,314,604 B1 to Tom Ahlstrom et al; U.S. Pat. No. 5,689,851 to de Sevren Jacquest; D U.S. Pat. No. 278,966 to Anaya; U.S. Pat. No. 4,589,159 to Streibel and U.S. Pat. No. 4,735,325 to Remmers.

Desjardin describes an integral clip formed from the flat handle portion of the tool with the support, handle and blade of the tool of the same plane. This invention requires the support to be manually displaced outwardly from the plane of the tool to engage with a supporting container and thus possibly contaminating the hands of the user. The clip contains a perimeter relief which is essentially an opening in the blade and handle interface area and the substance being mixed or transferred may easily fall through the opening. The tool is essentially planar and provides no support on a flat surface.

Ahlstrom et al describes a support for a paintbrush which both supports the brush on a flat surface and the edge of a container. The support provides no additional engagement or frictional holding or directional alignment other than resting on the edge of the container. To accomplish stability on a flat surface two nibs are extended beyond the arched flange of the support.

de Sevren Jacquest describes a built-in recess in the handle of a paintbrush which suspends it on the inner sealing flange of a paint container. The handle-hanger recess offers no frictional or gravitational gripping advantage other that direct downward force and there is no provision to support the paintbrush handle or bristles above a flat surface.

Anya describes an ornamental design of a trowel with a protrusion between the blade and the handle. The ornamental protrusion offers no frictional or gravitational gripping advantage other than direct downward force and there is no provision to support the blade or handle of the trowel above a flat surface.

Streibel describes a toothbrush with a name-bearing member on the end of the handle that also supports the toothbrush on a bracket. The name-bearing member offers no frictional or gravitational gripping advantage other that direct downward force and there is no provision to support the bristles of the toothbrush above a flat surface.

Remmers describes a support clip which engages a wire in shelving and allows the shelf to pivot in a vertical arc while stabilizing horizontal movement. The aperture has a smaller opening than the diameter of the aperture thus securely holding the installed shelving, but it does not directionally orient the shelving in any particular plane due to the round shape of the aperture.

Also, of interest is U.S. Pat. No. 5,769,383 to Hemler which describes a brush retaining system for suspending a paintbrush over a paint can. The clip suspends the brush gravitationally with no additional frictional assistance due to aperture design.

Of only minimal interest is U.S. Pat. No. 5,406,668 to MacDonald showing a paintbrush with a built-in holder which pivots out of the plane of the handle suspending the brush in a container. Also of minimal interest is U.S. Pat. No. 5,087,014 to Desjardin showing a clip for holding a tool on a container in two positions. Both methods rely on direct downward gravitational force to hold the paintbrush in position and offer no additional frictional advantage.

There remains the need for a tool support that provides enhanced holding means while suspended on the rim of a container or a support rod while providing the option for directional alignment of the tool with the additional means to suspend the handle or the functional end of the tool above a flat surface while resting the tool on that surface.

OBJECTS AND ADVANTAGES

Accordingly, several objects and advantages of the present invention are:

(a) to provide a support with an aperture for a tool that will support the tool on the rim of a container;

(b) to provide a support with an aperture for a tool that will support the tool on a support rod;

(c) to provide a support with an aperture for a tool that will support the tool on the rim of a container or a support rod and provide enhanced holding means for the tool;

(d) to provide a support with an aperture for a tool that will support the tool on a support rod with a flat edge thus holding the tool in a directionally predetermined and stable position;

(e) to provide a support with an aperture for a tool that will support the tool on a flat surface so that the handle end of the tool is suspended above the flat surface;

(f) to provide a support with an aperture for a tool that will support the tool on a flat surface so that the functional end of the tool is suspended above the flat surface;

(g) to provide a support for a tool that will accomplish (a), (b), (c), (d), (e), and (f) as listed previously with the identical support structure incorporated with the tool.

A toothbrush incorporating this invention will accomplish (a), (b), (c), (d), (e), (f) and (g) as listed previously with the additional advantage of having the bristles supported in an upright position. This feature offers the advantage of suspending the oral contact area of the toothbrush thus reducing the incidence of contact with undesirable surfaces. Furthermore, this position facilitates drying of the bristles between uses. An additional advantage is that the toothbrush incorporating this invention may readily be affixed to existing bathroom accessory wire shelf units utilized in bathtubs and showers for holding bathing items.

Similarly, a razor incorporating this invention will accomplish (a), (b), (c), (d), (e), (f) and (g) as listed previously with the additional advantage of having the blade holder supported in an upright position. This feature protects the sharpness of the blade by reducing contact with other surfaces and facilitates the drying of the blade between uses. An additional advantage is that the razor incorporating this invention it may readily be affixed to existing bathroom accessory wire shelf units utilized in bathtubs and showers for holding bathing items.

A task tool handle incorporating this invention will accomplish (a), (b), (c), (d), (e), (f) and (g) as listed previously when joined with task tools such as metal removal files and food preparation tools. Additionally, the handle has the advantage of protecting the tool from contact with other tools while hanging from a common support rod. Metal removal files, for example, are easily damaged when placed in a drawer as the hardened cutting surface is dulled when in contact with other files. Food preparatory tools have shaped and sharpened surfaces that are optimally maintained by not contacting other tools and objects. An additional advantage is that the handle support can function as a pivot point and a handle that has a greater mass than the tool in relation to the support will suspend the tool above a flat surface on which the handle is resting thus preventing contamination of the tool. Similarly, if the tool has a greater mass that the handle, the support suspends the gripping portion of the handle above the flat surface thus providing a handle that is not contaminated by the surface and is positioned for the user to grasp. The two previously mentioned advantages are significant in the food service industry, the medical field, in laboratories, in clean-room facilities and in machine tool manufacturing.

An instrument clip incorporating this invention will accomplish (a), (b), (c), (d), (e), (f) and (g) as listed previously with the additional advantage of being able to organize the instruments on the rim of a container or a support rod. An additional object can be accomplished by manufacturing the instrument clip in various colors to assist in identification of the instrument.

A utensil incorporating this invention will accomplish (a), (b), (c), (d), (e), (f) and (g) as listed previously with the additional advantage of suspending the task device end of the utensil within or over the open container which contains the substance being mixed or manipulated by the utensil. An additional advantage is that the utensil can be suspended in proximity to the substance thus preventing drips and spillage of the substance from the utensil as the utensil is moved to a resting place.

A universal support hanger incorporating this invention will accomplish (b) and (d) as listed previously with the additional advantage of being able to position the hanger in an infinite number of locations on the flattened support rod. An additional advantage is that the hanger provides a means of displaying lettering, numbers, signs and graphics, objects, and numerous other items in an economical manner. Another advantage is that several hangers can be attached to a larger object for suspension. Another advantage is that due to the directionally predetermined and stable position, each item will share a common plane.

Further objects and advantages of my invention will become apparent from a consideration of the drawings and ensuing description.

SUMMARY OF THE INVENTION

The present invention relates to a method and device for supporting a tool or a display item in a more secure and directionally stable configuration. The invention calls for providing an aperture with a line inside the aperture sloping toward the opening of the aperture. The sloping line describes a smaller opening in the aperture than the size of the aperture thus securing dimensionally complimentary objects within the aperture. The tool is supported upon various cross-sectional shapes in a more secure manner due to the frictional and gravitational forces acting upon essentially an inclined plane described by the line within the aperture.

Figure 1:
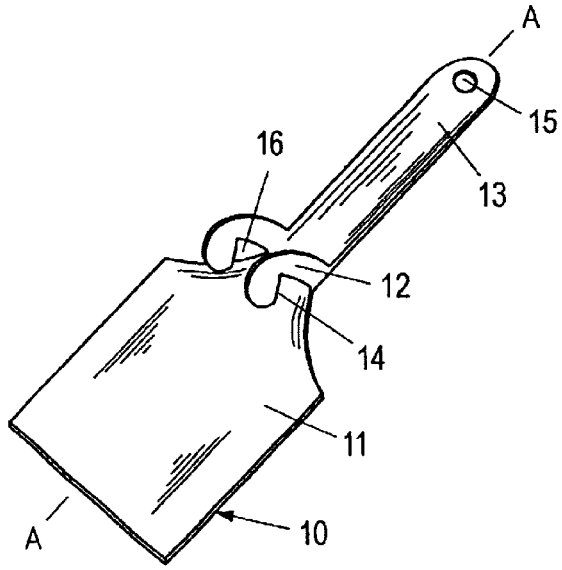
FIG. 1 is a perspective view of the first embodiment of the tool 10 constructed in accordance with the invention.

REFERENCE LETTERS AND NUMERALS:

| | |
|---|---|
| | Plane A of blade 11 and 11A |
| B | angle between plane A—A and line 14 |
| C | angle between plane A—A and surface 9 |
| D—D | cross-sectional view of blade 11A of tool 10A |
| E—E | plane of support bracket 36 and bracket clamping spring 34 |
| F—F | cross-sectional view of support bracket 36 |
| G—G | cross-sectional view of support bracket 36 and bracket clamp spring 34 |
| H | arc of bracket clamp spring 34 |
| J—J | plane of support rods 45 and 45A |
| K—K | cross-sectional view of support rods 45 and 45A |
| L—L | plane of handle 53 of shaver 50 |
| M—M | cross-sectional view of support rod 45 with razor 50 |
| N—N | plane of flat edge of support rod 45B |
| P | angle between plane L—L and line 14E |
| P1 | angle between plane L—L and line 14E |
| Q—Q | plane of task tool handle 60 |
| R | angle between plane Q—Q and surface 9 |
| R—R | cross-sectional view of instrument clip 70 |
| S—S | sectional view of instrument clip 70 and support rods 45 and 45A with instrument 76 |
| T—T | cross-sectional view of universal support hanger 90 |
| U—U | cross-sectional view of universal support hanger 90 with display item 95 supported on support rod 45B |
| 9 | surface |
| 10 | tool |
| 10A | tool (second embodiment) |
| 10B | tool (third embodiment) |
| 11 | blade |
| 11A | blade |
| 12 | support |
| 12B | support |
| 13 | handle |
| 14 | line |
| 14B | curved line |
| 14C | line |
| 14D | line |
| 14E | line |
| 14F | line |
| 14G | line |
| 14H | line |
| 14J | line |
| 15 | hole |
| 16 | aperture |
| 16B | aperture |
| 16C | aperture |
| 16D | aperture |
| 16E | aperture |
| 16F | aperture |
| 16G | aperture |
| 16H | aperture |
| 16J | aperture |
| 17 | rim |
| 18 | container |
| 19 | bail handle |
| 30 | tool hanger attachment (fourth embodiment) |
| 31 | hole |
| 31A | hole |
| 31B | threaded screw |
| 31C | fastener |
| 32 | support |
| 33 | body |
| 34 | support bracket clamp spring |
| 35 | hole |
| 36 | support bracket |
| 37 | hole |
| 38 | implement handle |
| 40 | toothbrush (fifth embodiment) |
| 41 | head |
| 42 | support |
| 43 | handle |
| 44 | bristles |
| 45 | upper support rod |
| 45A | lower support rod |
| 45B | flat support rod |
| 47 | container |
| 47A | rim |

-continued

| REFERENCE LETTERS AND NUMERALS: | |
|---|---|
| 48 | suction cup |
| 49 | support rod and suction cup assembly |
| 50 | razor (sixth embodiment) |
| 51 | blade holder |
| 52 | support |
| 53 | handle body |
| 60 | task tool handle (seventh embodiment) |
| 61 | recess |
| 62 | support |
| 63 | handle body |
| 65 | task tool |
| 70 | instrument clip (eighth embodiment) |
| 71 | gap |
| 72 | support |
| 73 | cavity |
| 74 | right cavity wall |
| 74A | left cavity wall |
| 75 | partition |
| 76 | instrument |
| 77 | instrument handle |
| 78 | instrument task end |
| 80 | utensil (ninth embodiment) |
| 81 | task device |
| 82 | support |
| 83 | handle |
| 87 | rim |
| 87A | lip rim |
| 88 | container |
| 88A | lipped container |
| 90 | universal support hanger (tenth embodiment) |
| 91 | hinge point |
| 92 | pressure arm |
| 93 | joining leg |
| 94 | joining material |
| 95 | display item |

DESCRIPTION OF EMBODIMENTS

Figure 1A:
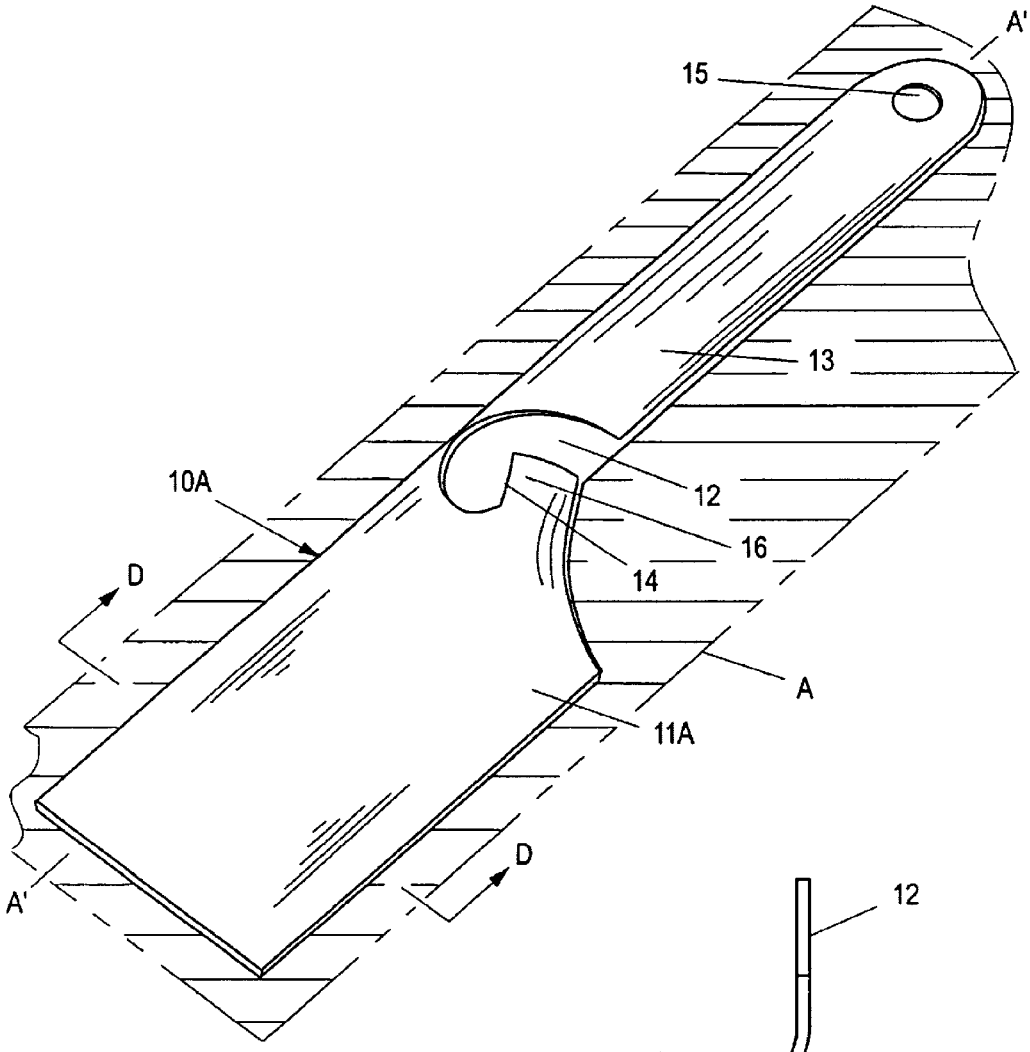
FIG. 1A is a perspective view of the tool 10A showing the second embodiment.
Figure 2A:
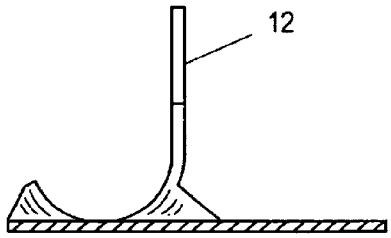
FIG. 2A is a cross-sectional view D—D of FIG. 1A.
Figure 1B:
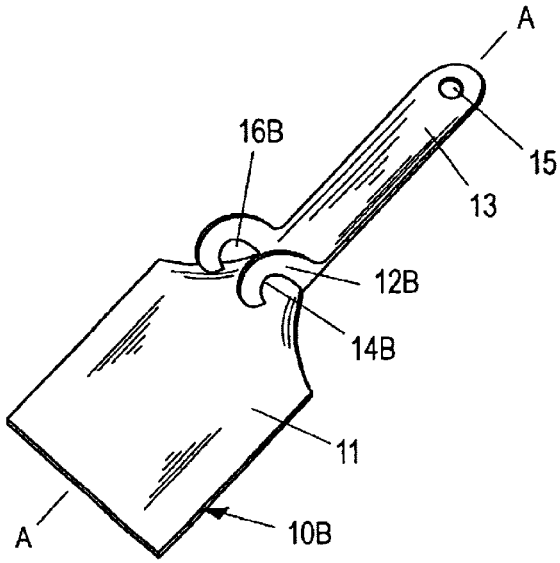
FIG. 1B is a perspective view the tool 10B showing the third embodiment.

FIGS. 1 and 1B show a tool 10 and 10B respectively with a first end and a second end. On the first end is a blade 11 and on the second end is a handle 13 and they form a longitudinal axis A'—A' of the tool 10 and 10B. The blade 11 is preferably flat and has a left and right side or width and has a length along the axis A'—A' which form the plane A of the blade 11. The blade 11 extends beyond the width of the handle 13. The handle 13 has a width described by a left side and a right side. The width of the handle is preferably less than the length along the axis A'—A'. The handle 13 has a hole 15 at the end furthest from the blade 11. The handle 13 is preferably contoured in a U-shape. Between the blade 11 and the handle 13 is a support 12 and 12B. The support 12 and 12B includes a first leg and a second leg. The first leg and second leg are preferably identical on the support 12 and 12B respectively. The legs have a first end and a second end and are connected to the handle 13 at the first end. The legs have a curved shape with an inner edge forming an aperture 16 and 16B. The legs are preferably positioned such that the aperture 16 and 16B is positioned between the inner edge of the support 12 and 12B respectively and the blade 11. The second end of the legs and the blade 11 form the opening of the aperture 16 and 16B. The inner edge of the legs adjacent the second end curves inward along a line 14 and a curved line 14B toward the blade 11 such that the distance between the inner edge and the blade at the second end is less than the distance between the inner edge and the blade at a point on the inner edge directly adjacent the first end of the legs. The inner edge of the legs at the second end is the line 14 and is straight in the first embodiment and is the curved line 14B and is curved in the third embodiment. The line 14 and the curved line 14B form a hook shape that bends in toward the blade 11 nearest the opening of the aperture 16 and 16B respectively.

Figure 2:
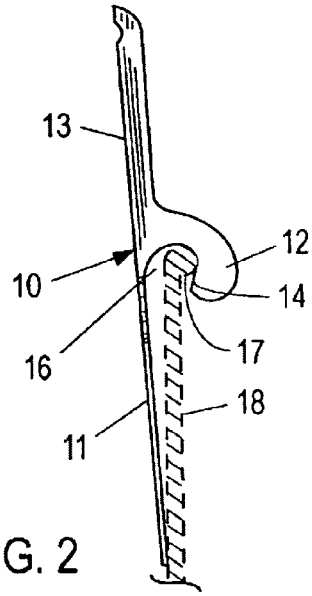
FIG. 2 is a right side view of the first embodiment suspended on the rim 17 of the container 18.
Figure 2B:
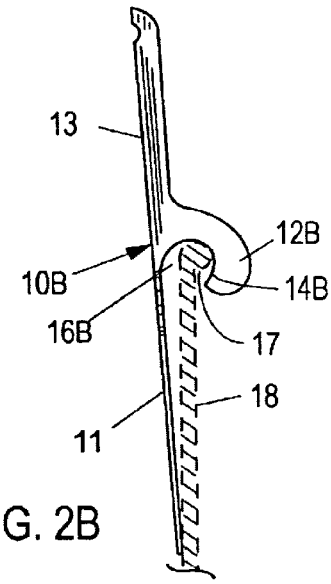
FIG. 2B is a right side view of the third embodiment suspended on the rim 17 of the container 18.

FIGS. 2 and 2B show the tool 10 and 10B respectively supported on a rim 17 of a container 18. The rim 17 is shown at the furthest extent of the aperture 16 and 16B at a point closest to the handle 13 end of the tool 10 and 10B respectively.

Figure 3:
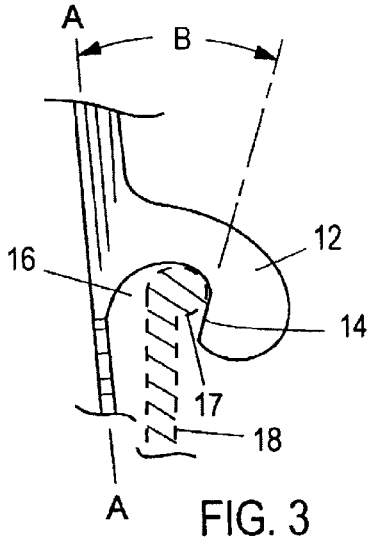
FIG. 3 is an enlarged partial view of FIG. 2.

FIGS. 3 shows an enlarged partial view of FIG. 2. The plane A—A and the line 14 form an angle B.

Figure 3B:
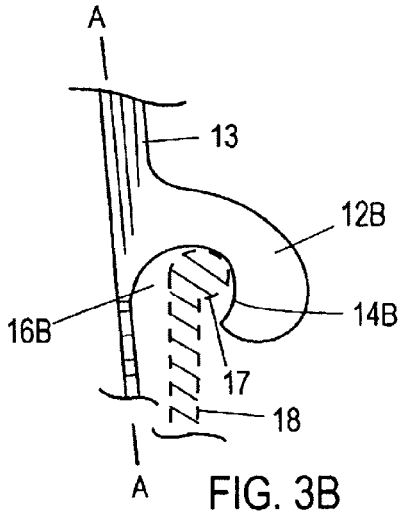
FIG. 3B is an enlarged partial view of FIG. 2B.

FIG. 3B is an enlarged partial view of FIG. 2B.

Figure 4:
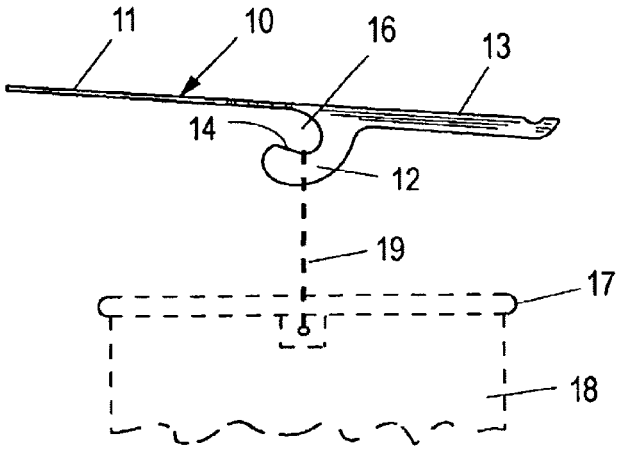
FIG. 4 is a right side view of the first embodiment lifting the container 18 by the bail handle 19.
Figure 4B:
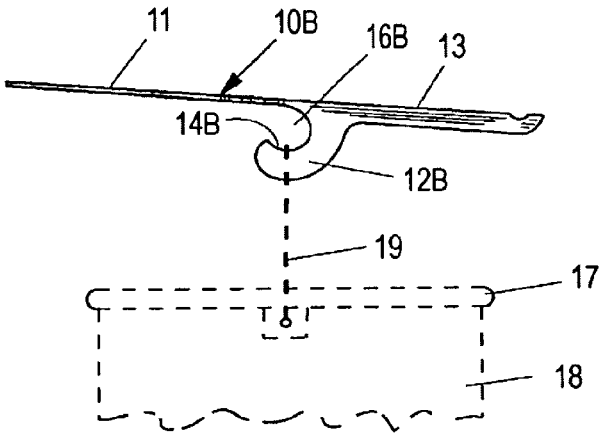
FIG. 4B is a right side view of the third embodiment lifting the container 18 by the bail handle 19.

FIGS. 4 and 4B show the tool 10 and 10B respectively lifting the container 18 by a bail handle 19 with the inner edge of the support 12 and 12B respectively. The bail handle 19 is shown inside the aperture 16 and 16B at a point along the line 14 and the curved line 14B respectively at the furthest point from the blade 11 adjacent the first end of the support 12 and 12B respectively.

Figure 5:
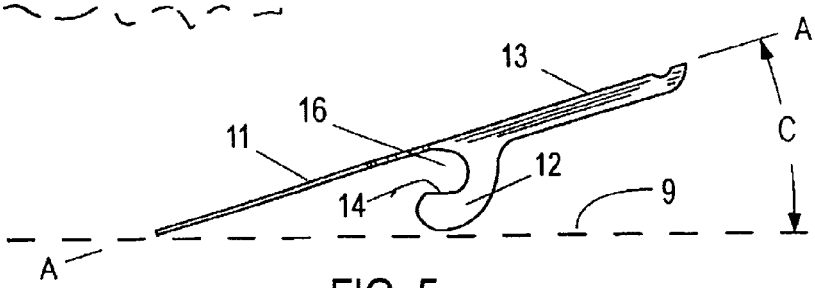
FIG. 5 is a right side view of the first embodiment supported on the surface 9.
Figure 5B:
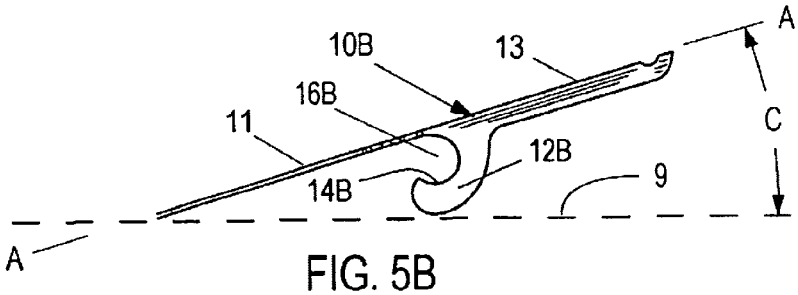
FIG. 5B is a right side view of the third embodiment supported on the surface 9.

FIGS. 5 and 5B show the tool 10 and 10B respectively on a surface 9 supported by the blade 11 and the support 12 and 12B respectively with the handle 13 above the surface and at an angle C to the surface.

FIG. 1A shows an alternate embodiment in the tool 10A. The tool 10A has a right and left side of a blade 11A where the right side of the blade aligns with the right side of the handle 13. The left side of the blade 11A extends beyond the left side of the handle 13. The single support 12 is as previously described and is on the left side of the handle 13 on the same side as the extension of the blade 11A.

FIG. 7 shows the lateral cross-sectional view D—D from the blade 11B end of the tool 10B showing the u-shape of the handle 13.

Figure 1C:
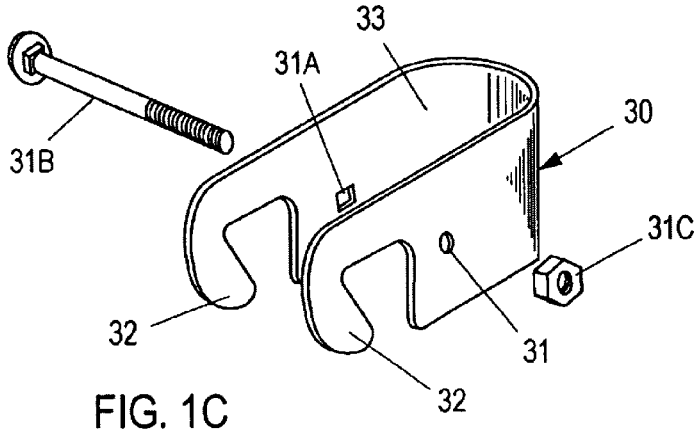
FIG. 1C is a perspective view of the tool hanger attachment 30 showing the fourth embodiment.

FIG. 1C is an alternate embodiment showing a tool hanger attachment 30. The tool hanger attachment 30 has a left side and a right side. The left side and the right side are preferably identical and have a support 32 with an aperture 16C and a line 14C along the inner edge of the aperture as previously described. The left side and right side are preferably parallel and are joined by a body 33 with a u-shape. The body 33 has a hole 31 on the left side and a hole 31A on the right side. The holes 31 and 31A are opposing and accept a threaded screw 31B with a fastener 31B.

Figure 2C:
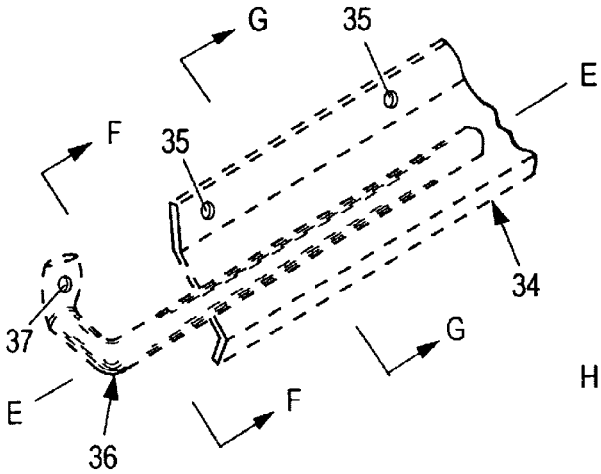
FIG. 2C is a perspective partial view of the support bracket 36 and the bracket clamp spring 34.

FIG. 2C shows a support bracket 36 with a hole 37 for mounting parallel to a support bracket clamp spring 34 with a hole 35 for mounting.

Figure 3C:
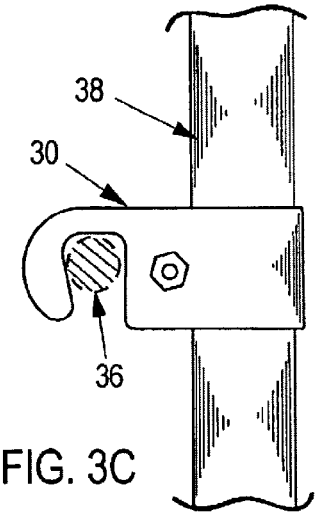
FIG. 3C is a left view of the fourth embodiment attached to a partial view of the implement handle 38 supported on a cross-sectional view F—F of the support bracket 36.

FIG. 3C shows the tool hanger attachment 30 clamped to a partial view of an implement handle 38 with the threaded screw 31B and the fastener 31C supported on the cross-sectional view F—F of the support bracket 36.

Figure 4C:
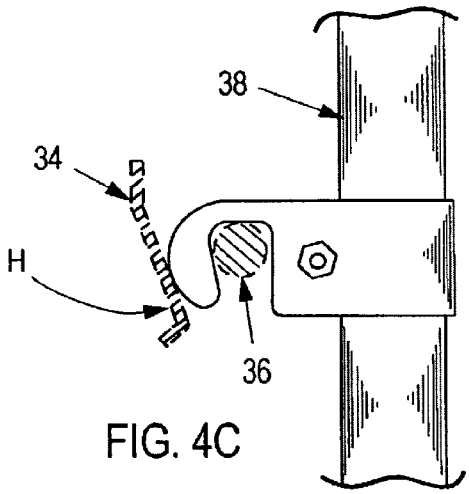
FIG. 4C is a left view of the fourth embodiment attached to a partial view of implement handle 38 supported on a cross-sectional view G—G of the support bracket 36 with the bracket clamp spring 34 engaged.

FIG. 4C shows the tool hanger attachment 30 clamped to a partial view of an implement handle 38 with the threaded screw 31B and the fastener 31C supported on the cross-sectional view G—G of the support bracket 36 with the bracket clamp spring 34 shown pressing against the support 32 in an arc H.

Figure 5C:
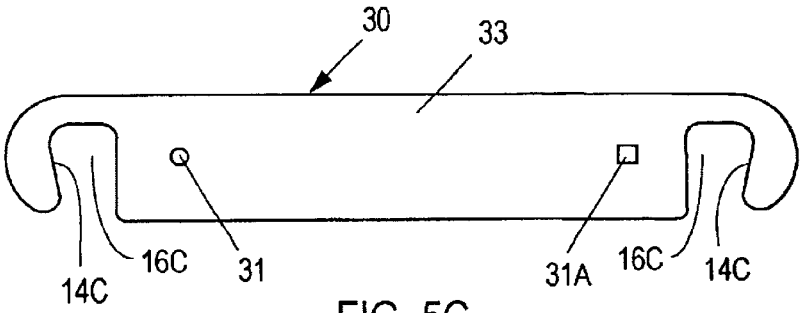
FIG. 5C is a planar view of the fourth embodiment.

FIG. 5C shows a planar view of the tool hanger attachment 30.

Figure 1D:
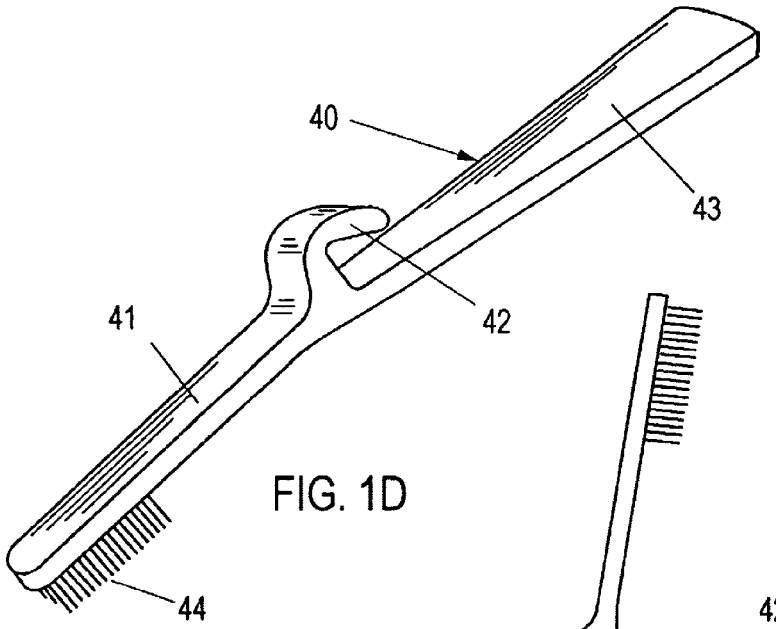
FIG. 1D is a perspective view of the toothbrush 43 showing the fifth embodiment.

FIG. 1D is an alternate embodiment showing a toothbrush 40. The toothbrush 40 has a first end and a second end. On the first end is a head 41 and on the second end is a handle 43. The head 41 has a grouping of bristles 44 at the end furthest from the handle 43 on the anterior side. Between the head 41 and the handle 43 is a support 42. The support 42 is located on the posterior side of the to toothbrush 40 and has an aperture 16D. The support 42 has a first end and a second end and is connected to the handle 43 at the first end. The support 42 has a curved shape with an inner edge forming the aperture 16D. The support 42 is preferably positioned such that the aperture 16D is positioned between the inner edge of the support and the handle 43. The second end of the support 42 and the posterior side of the handle 43 form the opening of the aperture 16D. The inner edge of the support 42 adjacent the second end curves inward along a line 14D toward the handle 43 such that the distance between the inner edge and the handle at the second end is less than the distance between the inner edge and the handle at a point on the inner edge directly adjacent the first end of support.

Figure 2D:
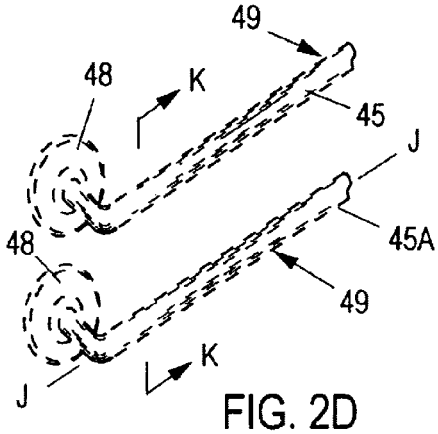
FIG. 2D is a perspective left side partial view of the support rods with suction cups 49.

FIG. 2D shows a partial view of two of the support rod and suction cup assembly 49 with an upper support rod 45 and a lower support rod 45A. The upper support rod 45 and the lower support rod 45A are preferably identical and are bent at a right angle near each end and have a suction cup 48 attached to each of the distal ends. The upper support rod 45 and lower support rod 45A are suspended at a horizontal distance from the surface with the suction cups 48 on a preferably vertical flat surface and are preferably parallel to each other and level on a plane J—J.

Figure 3D:
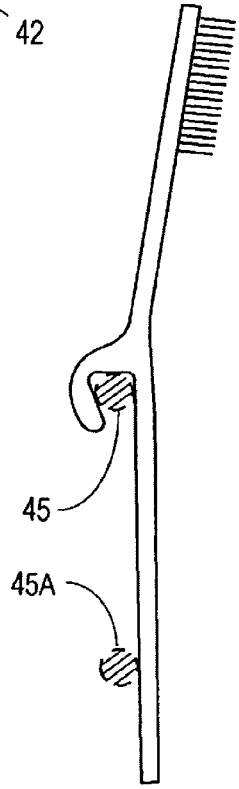
FIG. 3D is a left side view of the fifth embodiment supported on the cross-sectional view K—K of the support rods 45 and 45A.

FIG. 3D shows the toothbrush 40 supported on a sectional view K—K of the upper support rod 45 with the handle 43 aligned with the lower support rod 45A. The upper support rod 45 is shown at the furthest extent of the aperture 16D at a point closest to the head 41.

Figure 4D:
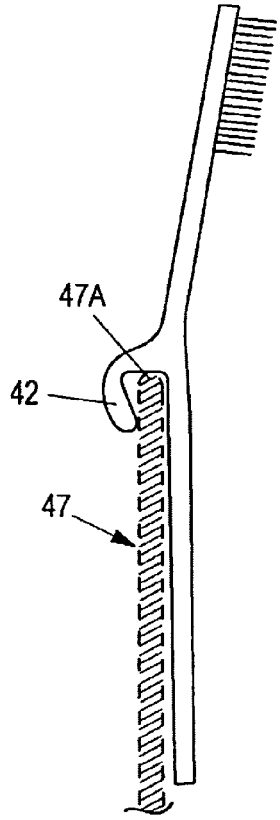
FIG. 4D is a left side view of the fifth embodiment supported on a partial sectional view of the rim 47A of the container 47.

FIG. 4D shows the toothbrush 40 supported on a sectional partial view of a rim 47A of a container 47. The rim 47A is shown at the furthest extent of the aperture 16D at a point closest to the head 41. The handle 43 is shown parallel with the vertical edge of the container 47.

Figure 5D:
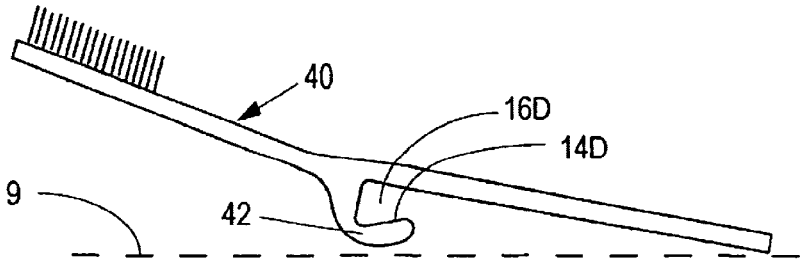
FIG. 5D is a left side view of the fifth embodiment supported on the surface 9.

FIG. 5D shows the toothbrush 40 supported on the surface 9. The toothbrush 40 is supported on the posterior side of the support 42 and the posterior side of the handle 43 at the end of the handle furthest from the head 41.

Figure 1E:
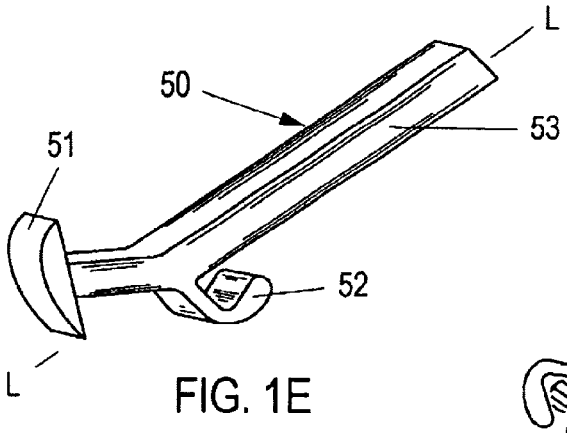
FIG. 1E is a perspective view of the razor 50 showing the sixth embodiment.

FIG. 1E is an alternate embodiment showing a razor 50. The razor 50 has a first end and a second end. On the first end is a blade holder 51 and on the second end is a handle 53. The handle 53 has a plane L—L. The blade holder 53 preferably angles away from the plane L—L toward the anterior side of the handle. The posterior side of the handle 53 is preferably parallel with the plane L—L. Between the blade holder 51 and the handle 53 is a support 52. The support 52 is located on the posterior side of the handle 53 and has an aperture 16E. The support 52 has a first end and a second end and is connected to the handle 53 at the first end. The support 52 has a curved shape with an inner edge forming the aperture 16E. The support 52 is preferably positioned such that the aperture 16E is positioned between the inner edge of the support and preferably the posterior side of the handle 53. The second end of the support 52 and the handle 53 form the opening of the aperture 16E. The inner edge of the support 52 adjacent the second end curves inward along a line 14E toward the posterior side of handle 53 such that the distance between the inner edge and the handle at the second end is less that the distance between the inner edge and the handle at a point on the inner edge directly adjacent the first end of support.

Figure 2E:
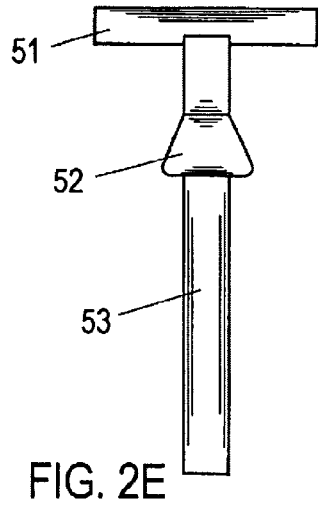
FIG. 2E is a posterior view of the sixth embodiment.

FIG. 2E shows the razor 50 with the support 52 on the posterior side of the razor.

Figure 3E:
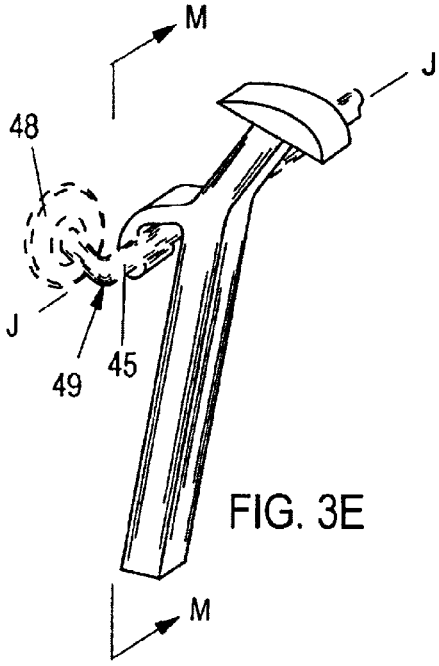
FIG. 3E is a perspective view of the sixth embodiment supported on the partial view of the support rod and suction cup assembly 49.

FIG. 3E shows the razor 50 supported on the support rod and suction cup assembly 49.

Figure 4E:
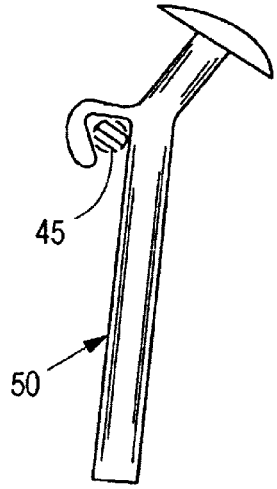
FIG. 4E is a sectional view M—M of FIG. 3E.

FIG. 4E is a sectional view M—M of FIG. 3E and shows the razor 50 supported on the support rod 45. The support rod 45 is shown at the furthest extent of the aperture 16E at the end closest to the blade holder 51.

Figure 5E:
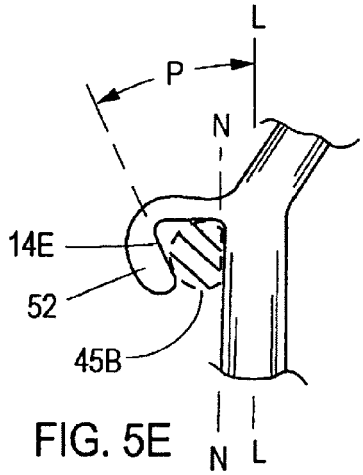
FIG. 5E is an enlarged partial left side view of the sixth embodiment supported on and fully engaged with the support rod 45B.

FIG. 5E is an enlarged partial view of the razor 50 supported on a cross-sectional view of an alternative embodiment of a flat support rod 45B. The flat support rod 45B has a flat edge on a plane N—N preferably on the side opposing the suction cup 48. The plane L—L of the handle 53 and the plane N—N of the flat support rod 45B are preferably parallel and produce an angle P with the line 14E. The flat support rod 45B is shown at the furthest extent of the aperture 16E at a point closest to the blade holder 51.

Figure 6E:
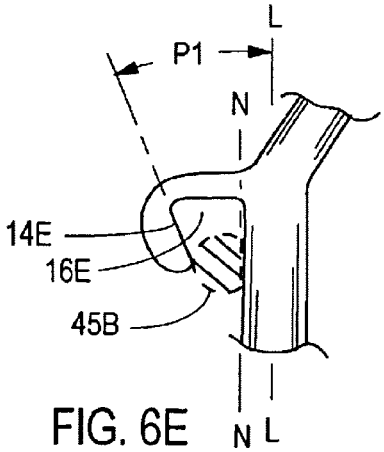
FIG. 6E is an enlarged partial left side view of the sixth embodiment partially engaged with the support rod 45B.

FIG. 6E is an enlarged partial view of the razor 50 partially engaged with a cross-sectional view of the flat support rod 45B. The plane L—L of the handle is shown parallel with the plane N—N of the flat support rod 45B. The inner surface of the aperture 16E at the second end of the support 52 at the point nearest the handle 53 on the line 14E is touching the side of the flat support rod 45B opposite the plane N—N which is in contact with the posterior side of the handle 53.

Figure 7E:
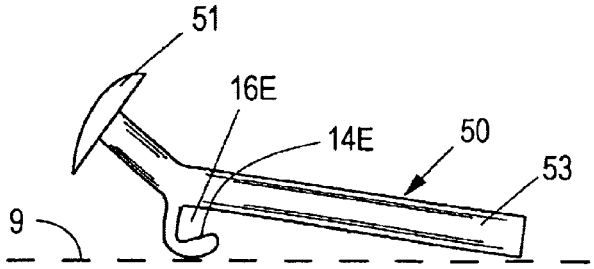
FIG. 7E is a left side view of the sixth embodiment supported on the surface 9.

FIG. 7E shows the razor 50 on the surface 9 supported by the posterior side of the support 52 and the posterior side of the handle 53 at the end furthest from the blade holder 51.

Figure 1F:
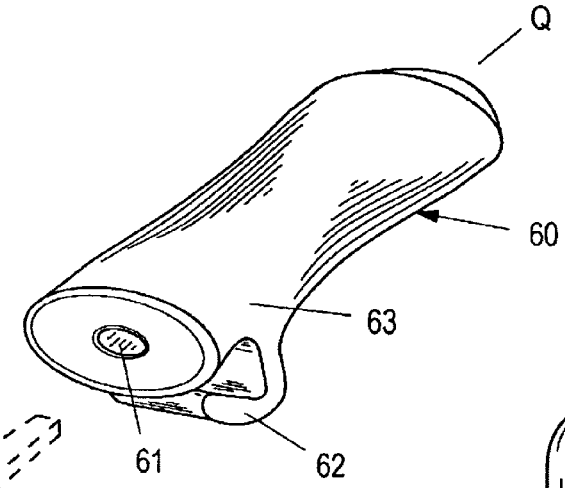
FIG. 1F is a perspective view of the task tool handle 60 showing the seventh embodiment.

FIG. 1F is an alternate embodiment showing a task tool handle 60. The task tool handle 60 has a handle body 63 having a first end and a second end along a plane Q—Q. The first end has a recess 61 in the handle body 63 to receive a task tool 65. The second end is preferably rounded and blends with the contour of the handle body 63. The handle body 63 has an anterior and posterior side. On the posterior side of the handle body 63 is a support 62 located on the recess 61 end of the handle body. The support 62 has a first end and a second end and is connected to the handle body 63 at the first end. The support 62 has a curved shape with an inner edge forming the aperture 16F. The support 62 is preferably positioned such that the aperture 16F is positioned between the inner edge of the support and the handle body 63. The second end of the support 62 and the handle body 63 form the opening of the aperture 16F. The inner edge of the support 62 adjacent the second end curves inward along a line 14F toward the handle body 63 such that the distance between the inner edge and the handle body at the second end is less that the distance between the inner edge and the handle body at a point on the inner edge directly adjacent the first end of support.

Figure 2F:
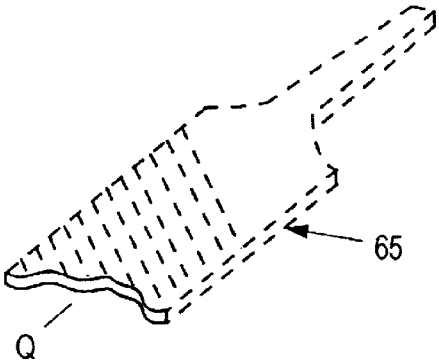
FIG. 2F is a view from the tool recess 61 end of the seventh embodiment.
Figure 2F:
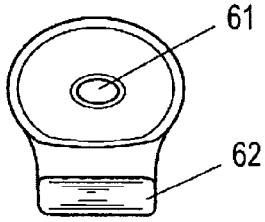

FIG. 2F shows the recess 61 end of the task tool handle 60 with the support 62 on the posterior side.

Figure 3F:
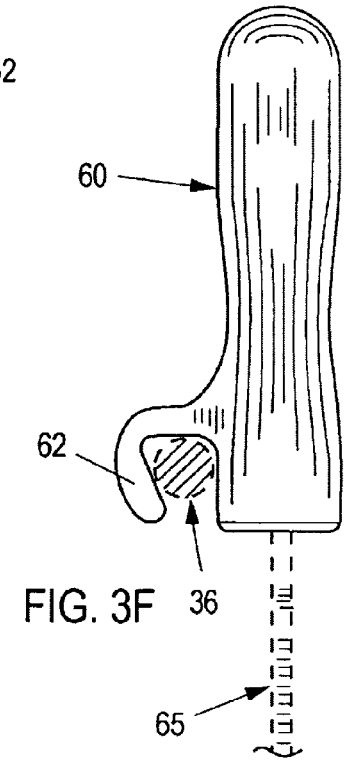
FIG. 3F is a right side view of the seventh embodiment with the task tool 65 installed in the recess 61 supported on a cross-sectional view F—F of the support bracket 36.

FIG. 3F shows the task tool handle 60 with a task tool 65 installed in the recess 61 supported on a support bracket 36. The support bracket 36 is shown at the furthest extent of the aperture 16F at a point closest to the second end of the task tool handle 60.

Figure 4F:
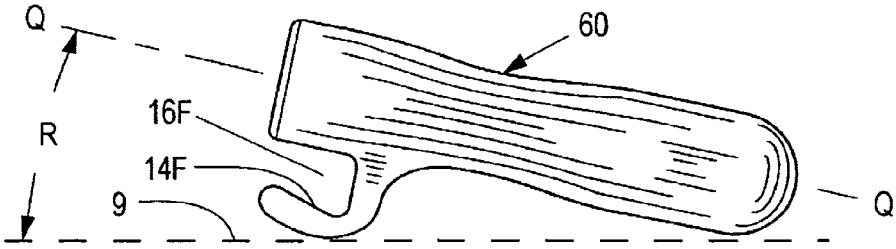
FIG. 4F is a left side view of the seventh embodiment supported on the surface 9.

FIG. 4F shows the task tool handle 60 on the surface 9. The task tool handle 60 is supported by the posterior side of the support 62 and the second end of the handle body 63 on the posterior side. The plane Q—Q of the task tool handle 60 describes an angle R with the surface 9.

Figure 1G:
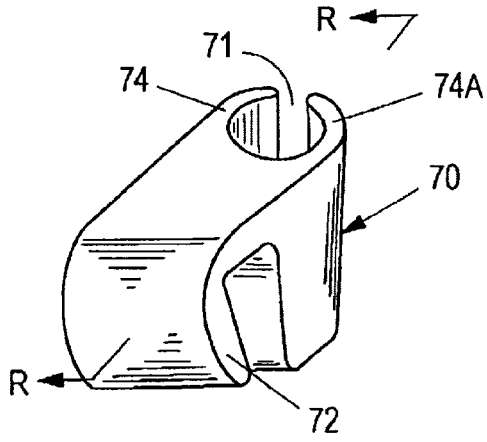
FIG. 1G is a perspective view of the instrument clip 70 showing the eighth embodiment.

FIG. 1G is an alternate embodiment showing an instrument clip 70. The instrument clip 70 has a first end and a second end. The first end has a support 72 and the second end has a cavity 73. The support 72 and the cavity 73 are separate by a partition 75. The support 72 has an aperture 16G. The support 72 has a first end and a second end and is connected to the partition 75 at the first end. The support 72 has a curved shape with an inner edge forming the aperture 16G. The support 72 is positioned such that the aperture 16G is positioned between the inner edge of the support and the partition 75. The second end of the support 72 and the partition 75 form the opening of the aperture 16G. The inner edge of the support 72 adjacent the second end curves inward along a line 14G toward the partition 75 such that the distance between the inner edge and the partition at the second end is less than the distance between the inner edge and the partition at a point on the inner edge directly adjacent the first end of support. The cavity 73 has a right cavity wall 74 and a left cavity wall 74A and a gap 71. The gap 71 is preferably at a point on the second end of the instrument clip 70 furthest from the first end. The right cavity wall 74 and left cavity wall 74A attach to the partition 75 at a point preferably furthest from the gap 71 and are preferably mirror images and identical.

Figure 2G:
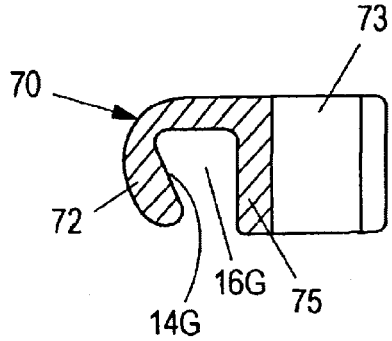
FIG. 2G is a left cross-sectional view R—R of FIG. 1G.

FIG. 2G shows a cross-sectional view R—R of the instrument clip 70 of FIG. 1G.

Figure 3G:
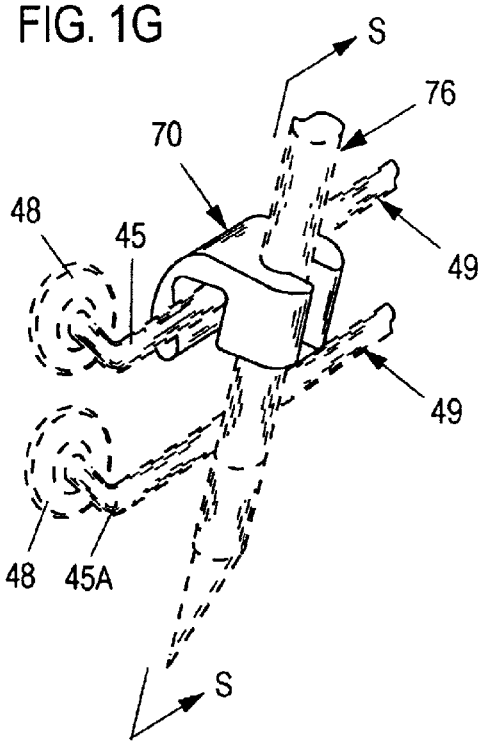
FIG. 3G is a perspective view of the eighth embodiment and the instrument 76 supported on the support rod and suction cup assembly 49.

FIG. 3G shows the instrument clip 70 with an instrument 76 supported on two of the support rod and suction cup assembly 49.

Figure 4G:
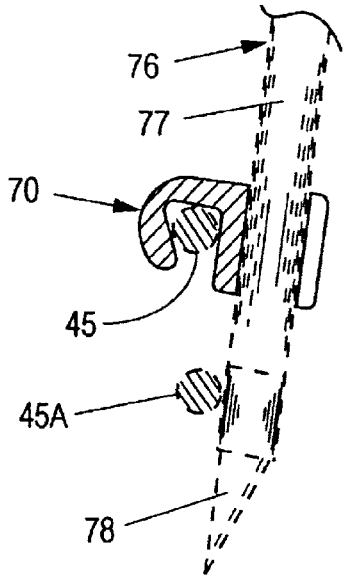
FIG. 4G is a cross-sectional view S—S of the eighth embodiment and the support rods 45 and 45A with the instrument 76.

FIG. 4G shows a sectional view S—S of the instrument clip 70 with an instrument 76 showing an instrument handle 77 in the cavity 73 and supported on the upper support rod 45 with a task end 78 of the instrument 76 aligned with the lower support rod 45A. The upper support rod 45 is shown at the furthest extent of the aperture 16G at a point furthest from the second end of the support 72.

Figure 5G:
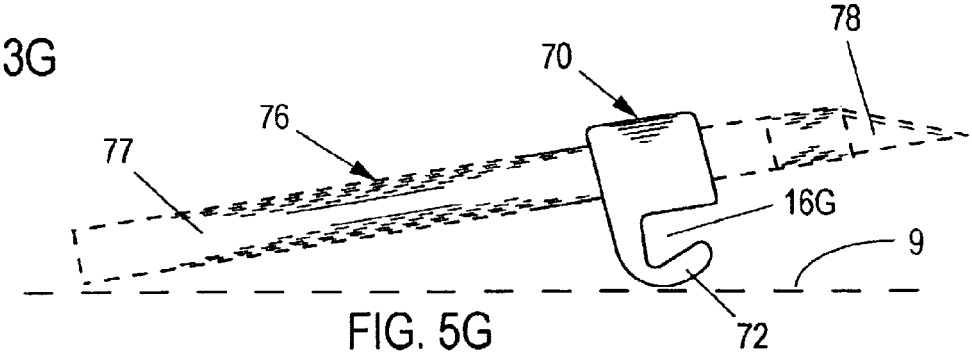
FIG. 5G is a left side view of the eighth embodiment and the instrument 76 supported on the surface 9.

FIG. 5G shows the instrument clip 70 with the instrument 76 supported by the support 72 and the end of the handle 77 furthest from the instrument task end 78 on the surface 9.

Figure 1H:
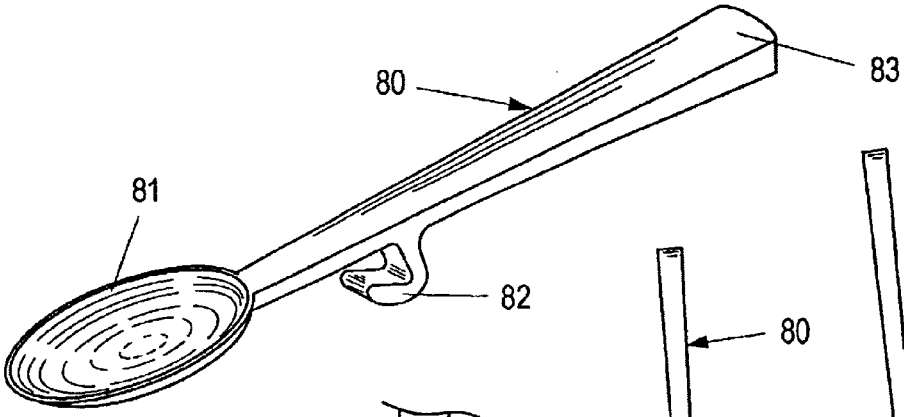
FIG. 1H is a perspective view of the utensil 80 showing the ninth embodiment.

FIG. 1H is an alternate embodiment showing a utensil 80. The utensil 80 has a first end and a second end. The first end has a task device 81 and the second end has a handle 83. Between the task device 81 and the handle 83 is a support 82. The support 82 is preferably located on the posterior side of the handle 83. The support 82 has a first end and a second end and is connected to the handle 83 at the first end. The support 82 has a curved shape with an inner edge forming an aperture 16H. The support 82 is preferably positioned such that the aperture 16H is positioned between the inner edge of the support and the handle 83. The second end of the support 82 and the handle 83 form the opening of the aperture 16H. The inner edge of the support 82 adjacent the second end curves inward along a line 14H toward the handle 83 such that the distance between the inner edge and the handle at the second end is less that the distance between the inner edge and the handle at a point on the inner edge directly adjacent the first end of support.

Figure 2H:
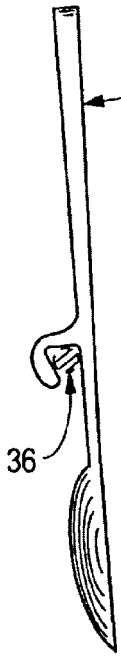
FIG. 2H is a right side view of the ninth embodiment supported on a cross-sectional view F—F of the support bracket 36.

FIG. 2H is a right side view showing the utensil 80 supported on the sectional view F—F of the support bracket 36. The support bracket 36 is shown at the furthest extent of the aperture 16H at a point closest to the end of the handle 83 that is furthest from the task device 81 end.

Figure 3H:
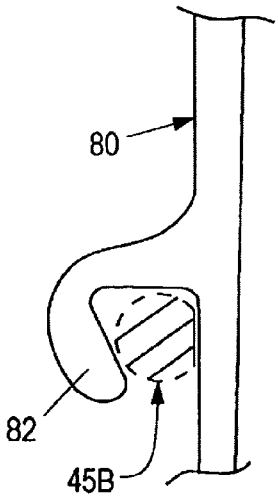
FIG. 3H is an enlarged partial view of the right side of the ninth embodiment and support rod 45B.

FIG. 3H is an enlarged partial right side view of the utensil 80 supported on a cross-sectional view of the flat support rod 45B.

Figure 4H:
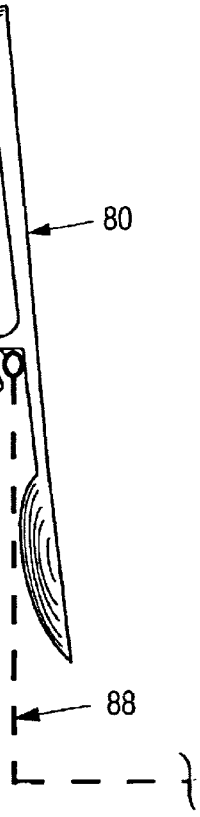
FIG. 4H is a right side view of the ninth embodiment supported on the rim 87 of the container 88.

FIG. 4H is a right side view showing the utensil 80 supported on a rim 87 of a sectional partial view of a container 88 with the task device 81 in contact with the vertical side of the container.

Figure 5H:
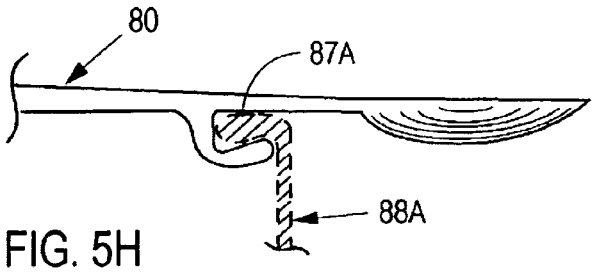
FIG. 5H is a right side view of the ninth embodiment supported on the. lip rim 87A of a lipped container 88A.

FIG. 5H is a right side partial view showing the utensil 80 supported horizontally on a lip rim 87A of a sectional partial view of a lipped container 88A. The lip rim 87A is similar to the shape of the aperture 16H thus accommodating the aperture and frictionally securing the utensil 80 to the lip rim.

Figure 6H:
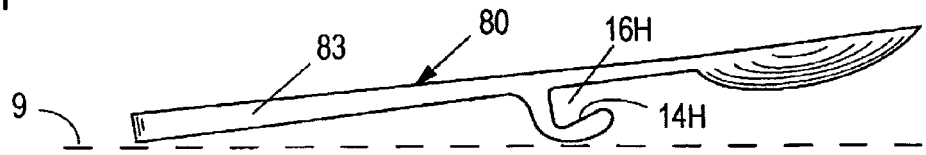
FIG. 6H is a right side view of the ninth embodiment supported on the surface 9.

FIG. 6H is a right side view of the ninth embodiment supported on the surface 9.

Figure 1J:
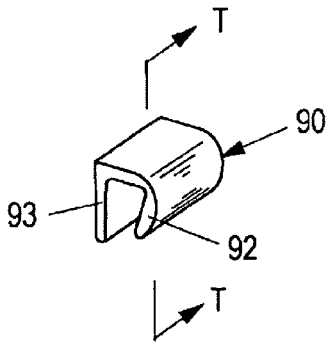
FIG. 1J is a perspective view of the universal support hanger 90 showing the tenth embodiment.

FIG. 1J is an alternate embodiment showing a universal support hanger 90. The universal support hanger 90 has a first side and a second side. The first side has a joining leg 93 and the second side has a pressure arm 92. The joining leg 93 and the pressure arm 92 have an inner edge forming a aperture 16J. The aperture 16J has a top edge opposite a bottom opening. The inner edge adjacent the pressure arm 92 has a line 14J and curves in toward the inner edge of the joining leg 93 at the bottom opening such that the distance between the inner edge of the pressure arm and the inner edge of the joining leg at the bottom opening is less than the distance between the inner edge of the pressure arm and the inner edge of the joining leg adjacent the top edge.

Figure 2J:
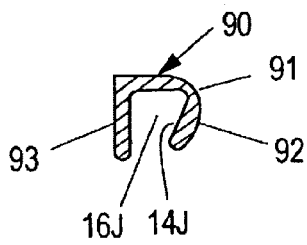
FIG. 2J is a cross-sectional view T—T of the tenth embodiment.

FIG. 2J is a cross-sectional view T—T of the universal support hanger 90 of FIG. 1J.

Figure 3J:
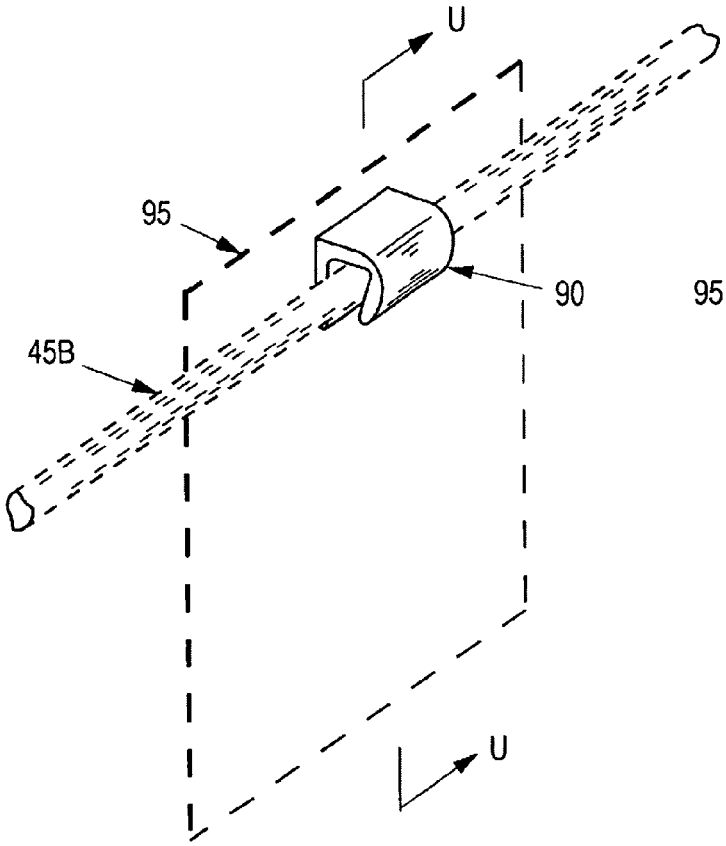
FIG. 3J is a perspective view of the tenth embodiment attached to the display item 95 supported on the support rod 45B.

FIG. 3J is a perspective view of the universal support hanger 90 attached to a display item 95 supported on the flat support rod 45B.

Figure 4J:
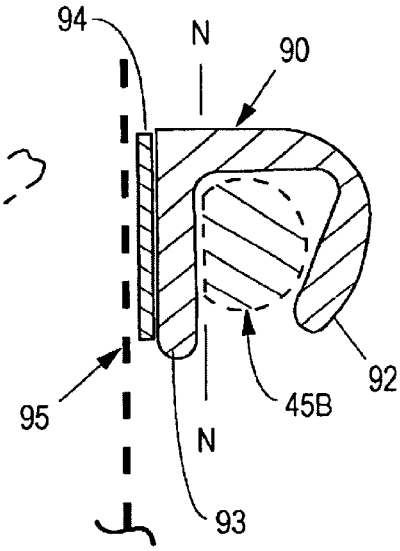
FIG. 4J is the cross-sectional view U—U showing the tenth embodiment attached to the display item 95 with the joining material 94 and supported on the support rod 45B.

FIG. 4J is an enlarged cross-sectional view U—U showing the universal support hanger 90 attached to the display item 95 with a joining material 94 supported on the flat support rod 45B. The inner edge of the joining leg 93 is shown in contact with and parallel to the plane N—N of the flat support rod 45B.

Operation:

To use the first, second and third embodiment of the invention a person will grasp the tool 10, 10A and 10B by the handle 13 and will pick up a variety of materials with the blade 11 or blade 11A. The position of the handle 13 spaced inward from the sides of the blade 11 and the left side of the blade 11A facilitates scraping viscous materials off the walls of a container or a surface while not contaminating the hand with the viscous material.

The tool 10, 10A and 10B can be suspended on the rim 17 of the container 18 by positioning the rim in the aperture 16 and 16B of the support 12 and 12B respectively as shown in FIGS. 2 and 2B. The angle B provided by the line 14 in relation to the axis A'—A' of the tool 10, 10A and 10B and the curved line 14B in relation to the blade 11 create a hook shape that helps secure the tool 10, 10A and 10B to the rim 17 as shown in FIGS. 3 and 3B. The aperture 16 and 16B also supports the tool 10, 10A and 10B on other vertical edges such as sheet-manufactured products, rails and toolbelts.

Another feature of the tool 10, 10A and 10B is that the hook shape of the aperture 16 and 16B can be used to lift the container 18 by the bail handle 19 as shown in FIGS. 4 and 4B. This feature facilitates moving of the container while isolating the hand from viscous material that may have contaminated the bail handle 19 and the outer edges of the container 18.

Another feature of the tool 10 and 10B is that it can be supported on the support 12 and 12B and the blade 11 upon the surface 9. FIGS. 5 and 5B show the tool 10 and 10B supported on the extension of the support 12 and 12B beyond the Plane A of the blade 11 thus elevating the handle away from the surface 9 at a distance described by the angle C. This distance allows the hand of a person to grasp the handle 13 while not touching the surface 9 thus reducing the risk of contamination from surface substances such as cements, adhesives and inks. This feature can also reduce contamination of the surface 9 with the handle 13 such as during food preparation or when supporting the tool 10 and 10B on a hot cooking surface or grille.

Another feature of the tool 10, 10A and 10B is a hole 15 provided in the handle 13 for hanging on a pin or hook such as a display in a store. The hole 15 may also be used to secure a lanyard or a safety hook.

Another embodiment of the tool 10 and 10B is accomplished by lengthening the handle 13 in relation to the length of blade 11 and placing the support 12 and 12B in a position closer to the blade 11. The blade 11 would thus be supported above the surface 9 and the tool would rest on the outer edge of the support 12 and 12A and the end of the handle 13 furthest from the blade.

The fourth embodiment of the invention is the tool hanger attachment 30 that is secured preferably to the implement handle 38 with the screw 31B and the fastener 31C via a clamping action. Additionally the tool hanger attachment 30 allows the implement connected to the implement handle 38 to be supported on the support bracket 36 in a substantially vertical plane. Additional support security for the implement is afforded by the support bracket clamp spring 34 that exerts a force in the arc H against the support 32 thus ensuring contact of the support bracket 36 with the inner edge of the aperture 16C along the line 14C. The line 14C on the tool hanger attachment 30 creates similar function to the line 14 on the tool 10 and 10B thus requiring additional forces to disengage the tool hanger attachment from the support bracket 36 due to the hook shape of the aperture 16C.

In the fifth embodiment the toothbrush 40 with the aperture 16D in the support 42 enables the toothbrush to be supported on the support rod and suction cup assembly 49 or on the rim 47A of the container 47. The placement of the support 42 in relation to the head 41 and the handle 43 supports the head above the surface 9 and also provides a barrier or stop for the fingers of the hand of a person holding the toothbrush 40.

In the sixth embodiment the razor 50 has the features of the toothbrush 40 and functions in a similar manner. An additional feature is exemplified in FIG. 5E with the razor 50 supported fully on the flat support rod 45B. The design of the aperture 16E creates a three-point contact with the flat support rod 45B. The first point of contact is on the posterior side of the handle 53 that is parallel with the plane L—L. The second point of contact is along the line 14E near the second end of the support 52 near the opening of the aperture 16E. The third point of contact is at the first end of the inner edge of the aperture 16E where the support 52 connects with the handle 53 at a point between the posterior side of the handle and the line 14E closest the first end. The support 52 is preferably constructed of a flexible material with the flex point between the posterior side of the support 52 and the posterior side of the handle 53. The partially engaged flat support rod 45B bends the second end of the support 52 in a posterior direction away from the handle 53 as shown in FIG. 6E. The partially engaged position creates an angle P1 that is less than angle P of FIG. 5E with plane L—L of the handle. In the fully engaged position of FIG. 5E the flat support rod 45B is fully engaged in the aperture 16E securing the razor 50 to the flat support rod with three points of contact. The arc created by the difference between angle P1 and angle P of the line 14E at second end of the support 52 due to the flexing between the first end and the second end of the support forces the flat support rod 45B toward the first point and third point of contact in the aperture 16E. In the fully engaged position the razor 50 is frictionally supported in a chosen plane L—L and requires a force greater that the gravitation force of the razor to dislodge it from the flat support rod 45B. In the instance where the desired plane L—L of support is not required, the support rod 45 of a rounded cross-section would function in the same manner less the chosen planar dimension offered by the flat support rod 45B.

In the seventh embodiment the task tool handle 60 has support features similar to the previously mentioned embodiments. Additionally the multiplicity of task tools 65 that can be utilized with the task tool handle 60 will influence the dimensional considerations and balance point of the task tool handle. Additionally a weighted handle body 63 in relation the task tool 65 weight in relation to the placement of the support 62 will allow the task tool to be supported above the surface 9 on the preferred plane Q—Q at an angle R as shown in FIG. 4F.

In the eighth embodiment the instrument clip 70 has the support features similar to the previously mentioned embodiments. Additionally the flexible material of the preferred embodiment expands to engage the instrument 76 by the instrument handle 77. The position of the instrument clip 70 in relation to the instrument handle 77 can be adjusted by sliding the instrument 76 within the cavity 73. The cavity 73 may be various shapes and sizes and the instrument clip 70 may be of diverse sizes.

In the ninth embodiment the utensil 80 has the support features similar to the previously mentioned embodiments. Additionally the flexible material of the preferred embodiment engages securely with the support bracket 36 and the flat support rod 45B. Additionally the aperture 16H of the support 82 engages with the complementary lip rim 87A on the lipped container 88A creating a utensil support system. Additionally the lip rim 87A supports the utensil 80 horizontally and at a right angle to the vertical wall of the lipped container 88A.

In the tenth embodiment the universal support hanger 90 has features similar to the previously mentioned embodiments. Additionally the universal support hanger 90 may be attached to a multiplicity of items with the joining material 94 attached to the outer edge of the joining leg 93. The preferable embodiment is of a flexible material with a flex point 91 between the pressure arm 92 and the joining leg 93 so that the universal support hanger 90 may be snapped onto the flat support rod 45B and removed repeatedly due to the interference fit of the three points of contact of the inner edge of the aperture 16J with the flat support rod. Additionally the directional alignment of the display items 95 joined to the universal support hanger 90 preferably shares the plane N—N of the flat support rod 45B. Additionally the universal support hanger 90 offers the flexibility of placement of diverse items on multiple parallel flat support rods 45B.

ADVANTAGES

According, the reader will see that the tool support of this invention can be incorporated into a variety of tools and a universal support hanger. In addition, the support can provide multiple support functions for the tool to include

- support on the rim on a container and
- support on a support rod and
- predetermined directional support for the tool and universal support hanger on a support rod with a flattened side and
- frictional resistance to accidental removal from the rim of a container or a support rod for the tool and the universal support hanger and
- support of the handle above a flat surface while resting on that surface and
- support of the task end of the tool above a flat surface while resting on that surface and
- all of the above functions with the identical support structure.

Although the description above contains many specificities, these should not be construed as limiting the scope of the invention but as merely providing illustrations of some of the presently preferred embodiments of this invention. For example the tool support can be incorporated into writing utensils, eyeglasses, portable telephones, remote control units and similar items that are picked up and set down frequently by the user and that would benefit from the multiple support functions as listed above.

I claim:

1. A tool which comprises:

a) a blade having opposed ends and opposed sides forming a plane;

b) a handle having opposed ends with one end of the handle connected to one end of the blade; and c) support having a first end and a second end with an inner edge extending between the ends and mounted at the first end on the end of the handle adjacent the blade, the support having a curved shape, and forming an aperture between the inner edge and the blade wherein i) the support extends out perpendicular to the plane of the blade, wherein ii) an opening of the aperture is positioned between the inner edge of the support and the blade wherein iii) the inner edge of the support adjacent the second end of the support is a straight line so that the support has a hook shape and extends in toward the blade adjacent the opening of the aperture and, wherein iv) a distance between the inner edge of the support adjacent the second end of the support and the one end of the handle adjacent the blade is less than a distance between the inner edge of the support and the handle at a point on the inner edge directly adjacent the first end of the support attached to the handle.

2. A tool for removing viscous material from a container, which comprises:

a) a blade, defining a first plane, having opposed ends with opposed sides extending between the ends;

b) a handle, defining a second plane that is substantially parallel to the first plane, having opposed ends with opposed sides extending between the ends with one end of the handle connected to on end of the blade; and c) a support having opposed ends with one end attached to the handle and extending outward from the handle, the support having a curved shape with an inner edge defining a space between said blade and said inner edge, and said space defining an aperture between the inner edge of the support and the blade.

3. The tool of claim 2 wherein the blade has a right and left side and the handle has a right and left side, wherein a width of the blade between the sides is greater than a width of the handle between the sides and wherein the handle is connected to the blade so that the right side of the blade is aligned with the right side of the handle and left side of the blade extends beyond the left side of the handle.

4. The tool of claim 3 wherein the support is attached adjacent the left side of the handle.

5. The tool of claim 2 wherein the support extends outward essentially perpendicular to the first plane.

6. The tool of claim 2 wherein an opening of the aperture is formed between the inner edge of the support adjacent the end of the support opposite the handle and the blade and wherein the inner edge of the support adjacent the end of the support opposite the handle bends in toward the blade.

7. The tool of claim 2 wherein the inner edge has a straight portion adjacent the end of the support opposite the handle.

8. A method for removing viscous material from a container which comprises the steps of:

a) providing a tool with a blade having opposed ends with opposed sides extending between the ends; a handle having opposed ends with opposed sides extending between the ends with one end of the handle connected to one end of the blade; and a support having opposed ends with one end attached to the handle and extending outward from the handle, the support having a curved shape with an inner edge and forming an aperture between the inner edge of the support and the blade;

b) inserting the blade of the tool into the viscous material in the container;

c) moving the blade of the tool in the viscous material so that the blade is essentially parallel to an open top of the container;

d) removing the blade having the viscous material from the container; and e) removing the viscous material from the blade of the tool.

9. The method of claim 8 wherein the blade of the tool has a right and left side and the handle has a right and left side wherein a width of the blade between the sides is greater than a width of the handle between the sides and wherein the handle is connected to the blade so that the right side of the blade is aligned with the right side of the handle and the left side of the blade extends beyond the left side of the handle and wherein further in step (c), the left side of the blade is moved along a wall of the container to scrape the viscous material off the wall of the container.

10. The method of claim 8 wherein after step (e), the tool is suspended on a rim of the container by positioning the rim of the container in the aperture formed between the inner edge of the support and the blade.

11. The method of claim 8 wherein the container has bail to lift the container and wherein after step (e), the tool is used to lift the container by positioning the bail in the aperture formed between the inner edge of the support and the blade, grasping the tool by the handle, holding the tool so that the handle and the blade are essentially parallel to an opening of the container and lifting and moving the tool to lift and move the container.

12. The method of claim 8 wherein after step (e), the tool is supported on a surface by positioning the tool with the blade and the support touching the surface and the handle of the tool is elevated away from the surface so that the handle can be grasped without contacting the surface.

* * * * *